US006993923B2

(12) United States Patent
Beers

(10) Patent No.: US 6,993,923 B2
(45) Date of Patent: Feb. 7, 2006

(54) LOAD BANK

(75) Inventor: Richard F. Beers, Ft. Lauderdale, FL (US)

(73) Assignee: Rich Beers Marine, Inc., Ft. Lauderdale, FL (US)

( * ) Notice: Subject to any disclaimer, the term of this patent is extended or adjusted under 35 U.S.C. 154(b) by 115 days.

(21) Appl. No.: 10/491,506

(22) PCT Filed: Oct. 5, 2001

(86) PCT No.: PCT/US01/31299

§ 371 (c)(1),
(2), (4) Date: Mar. 30, 2004

(87) PCT Pub. No.: WO03/031881

PCT Pub. Date: Apr. 17, 2003

(65) Prior Publication Data

US 2005/0072174 A1 Apr. 7, 2005

(51) Int. Cl.
*F25B 1/00* (2006.01)
*F25B 49/00* (2006.01)
*B63B 25/26* (2006.01)

(52) U.S. Cl. ..... 62/228.1; 62/240; 62/513; 322/7

(58) Field of Classification Search ..... 62/228.1, 62/513, 113, 185, 239, 240, 98, 99, 197; 322/7, 8

See application file for complete search history.

(56) References Cited

U.S. PATENT DOCUMENTS

| | | | | |
|---|---|---|---|---|
| 4,147,296 | A | 4/1979 | Spethmann | |
| 4,268,787 | A | 5/1981 | Sloan | |
| 4,463,574 | A | 8/1984 | Spethmann et al. | |
| 4,506,516 | A | 3/1985 | Lord | |
| 4,926,649 | A | 5/1990 | Martinez, Jr. | |
| 5,237,832 | A | 8/1993 | Alston | |
| 5,565,716 | A * | 10/1996 | Tierney, Jr. | 307/154 |
| 5,584,185 | A | 12/1996 | Rumble et al. | |
| 5,946,926 | A | 9/1999 | Hartman | |
| 6,208,038 | B1 * | 3/2001 | Campbell | 307/18 |
| 6,240,867 | B1 | 6/2001 | Hoyle et al. | |
| 6,263,689 | B1 | 7/2001 | Dodge et al. | |

* cited by examiner

*Primary Examiner*—Marc Norman
(74) *Attorney, Agent, or Firm*—Law Offices of Kenneth F. Dusyn; Kenneth F. Dusyn

(57) ABSTRACT

A system and method is disclosed for creating and/or maintaining an electrical load on a diesel engine generator for use on a marine vessel in order to avoid the harmful effects of no-load or low-load operation of the diesel engine. The parasitic load bank system 10 utilizes the heat transfer fluid 23 contained in the closed circulation loop 28 of a chille7d-fluid air conditioning system 14 for creating and/or maintaining the electrical load on the diesel engine generator 12 by utilizing a load bank controller 44 for diverting a portion 23*c* of the heat transfer fluid 23*a* being supplied to the vessel's air handlers 42 into heat exchange relationship with the heat transfer fluid 20*b* discharged from the air conditioning system's source of heat transfer 18 such that the heat exchanged heat transfer fluid 23*f* activates the source of heat transfer 18, which may be a chiller, reverse-cycle chiller or heat pump, to create an electrical power demand on the diesel engine generator 12.

91 Claims, 5 Drawing Sheets

LOAD BANK

BACKGROUND OF THE INVENTION

1. Field of the Invention

The invention relates to a load bank for diesel engines and more particularly to a system, apparatus and method that modifies and utilizes a chilled-fluid air conditioning system onboard a marine vessel for creating and/or maintaining an electrical load on one or more diesel engine-powered generators to avoid the deleterious and/or damaging effects of low-load or no-load operation for the diesel engine.

2. Background of the Invention

Marine diesel engine generators are designed for operation at predetermined temperatures and pressures that can only be achieved when the diesel engine powering the generator is operated under load, generally sixty percent of the engine's rated load capacity or greater. The operation of a diesel engine generator at low loads, particularly over a long period of time, can lead to undesirable consequences, among which are incomplete combustion of the diesel fuel resulting in fouled fuel injectors and valves; condensation formation within the engine which can cause the various parts of the internal engine to corrode and can also lead to a breakdown or degradation of the engine's lubricating oil; condensation of exhaust within the engine's exhaust stacks, commonly referred to as "wet stacking," as well as condensation in the manifolds thereby causing system corrosion and valve damage; system carbon buildup in the exhaust system resulting in the risk of an exhaust system fire; improper seating of the engine's gaskets and seals resulting in oil leaks; and improper seating of the engine's piston rings which will ultimately be responsible for excessive oil consumption and shortened piston and ring longevity thereby leading to reduced horse power for the engine. The foregoing effects of low load operation are cumulative over a period of time.

Load demands on diesel engine generators, particularly those used in marine operations onboard a seafaring vessel, are generally created by the vessel's electrical requirements. Marine engine generators are therefore designed and sized for the maximum anticipated load for providing electrical power to operate the vessel's air conditioning, pumps, motors, galley requirements, and appliances, etc., in the event that all of the vessel's electrical apparatus is on-line at any point in time.

One of the more varying electrical power demands onboard a seafaring vessel, and a common source for low-load engine operation, is created by the vessel's air conditioning system due to the substantial electrical requirements and the fluctuating conditions of the weather. The majority of larger marine vessels, such as yachts, utilize conventional fluid-chilled air conditioning systems to heat and cool the vessel as circumstances warrant. In the cooling mode, these systems employ a circulating heat transfer fluid for removing heat from various compartments and staterooms of the vessel. As shown in FIG. 1, the heat transfer fluid 23, typically fresh water, is pumped through a closed circulation loop 28 that extends through one or more sources of heat transfer, typically one or more chillers or reverse-cycle chillers represented by diagram box 18, for ultimately exchanging its heat with seawater 21 transported through the chiller(s) by the action of seawater pump 19. Once sufficiently cooled, the heat transfer fluid 23 is circulated to one or more air handlers (represented by diagram box 42) distributed throughout various locations of the vessel for absorbing the heat from the air in the vessel's compartments.

The heat-absorbed return heat transfer fluid 23 is then circulated back to the chiller(s) by the action of circulating pump 24 where it is cooled once again to complete the air conditioning cycle. The power for operating the chiller(s), pumps and other electrical apparatus in the air conditioning system is derived from diesel engine generator 12 when the vessel is at sea.

The conventional chiller, an example of which is described and illustrated in U.S. Pat. No. 4,926,649, comprises an evaporator in combination with a compressor and condenser for cooling the heat transfer fluid contained within the closed circulation loop. In applications for use onboard marine vessels, electrical power is supplied to the compressor by the diesel engine generator for drawing low pressure refrigerant gas from an evaporator, compressing it, and then discharging it in a higher pressurized gaseous state to a condenser. The condenser in turn condenses the hot gaseous refrigerant into a liquid by transmitting its heat to a second heat transfer fluid, typically seawater, pumped through the condenser. As the sea water is pumped through the chiller condenser, it absorbs the heat from the hot gaseous refrigerant and is returned back to the sea.

In the heating mode, i.e., when it is desired to supply heat to the circulating heat transfer fluid, a reversing valve is employed in the chiller for reversing the flow of refrigerant to the chiller's condenser in order to absorb heat from the sea water and transfer it to the circulating heat transfer fluid. In this mode of operation, the chiller acts as a heat pump and is referred to as a reverse-cycle chiller. A conventional heat pump may also be utilized, particularly when the vessel is relegated to cold climate operations.

As an example, a one hundred foot vessel may employ four 5-ton chillers to satisfy the air conditioning needs of the vessel's compartments. During the summer daytime hours, the heat load for the vessel will be sufficient to require that all of the four chillers be online. The electrical power demand for the operation of the chillers will create a sufficient load on the diesel engine generator(s) thereby more than satisfying the minimum load requirements for the generator(s). After sunset, however, the climate air temperature will drop and the heat load of the vessel will be substantially reduced. As the weather cools, the chillers will begin to stage off one by one, and only one of the four chillers will probably be needed to satisfy the vessel's cooling needs. It is during this time that the diesel engine which powers the generator(s) will be operating under very low-load conditions.

The situation is reversed when the vessel is navigating through a cooler climate or operating in cool-climate conditions. During the evening hours, the heating demand for the vessel will be sufficient to require that all four reverse-cycle chillers be online. Alternatively, resistant in-line water heaters may be employed in lieu of the reverse-cycle chillers. In any evert, their activation will require electrical power for the operation of all the reverse-cycle chillers (or in-line resistant water heaters, as the case may be), and the minimum required load on the diesel engine will be more than satisfied. After sunrise, however, the air temperature will increase and the heating demand for the vessel will be reduced. As the weather temperature increases, the reverse-cycle chillers will stage off one by one, and only one or two of the four chillers will probably be needed to maintain the vessel's heating needs. Once again, the engine generator(s) will be operating under low-load conditions.

3. The Related Art

An example of a refrigeration apparatus powered by a diesel engine generator is described in U.S. Pat. No. 5,584, 185, issued to Rumble et al. on Dec. 17, 1996. The refrigeration apparatus comprises a compressor, a water-cooled condenser, a chiller/evaporator and a positive displacement circulating pump, all of which are arranged in heat exchange relationship with a recirculating coolant circuit. The engine and refrigeration apparatus utilize an electronic control system that senses when electrical power is required or when the coolant temperature rises above a datum level so as to initiate a prescribed start sequence for the engine, and further, will automatically shut down the engine when a no-load is sensed for the engine. In the latter circumstance, the engine will remain on standby awaiting a power demand.

Multiple chilled-fluid producers are also disclosed in U.S. Pat. No. 6,240,867 B1, issued to Hoyle et al. on Jun. 5, 2001. The patent discloses their distribution within a watertight zone of a multiple-zoned naval ship for independent operation to avoid or reduce the risk of the vessel's functioning capability when impacted by a missile or torpedo. The chilled fluid producers disclosed may also require a flow of water, either sea or fresh water, into which heat can be rejected. U.S. Pat. No. 4,926,649 issued to Martinez, Jr. on May 22, 1990 also discloses the use of multiple chillers to cool a commercial building in a way that utilizes less energy by turning off one or more of the multiple chillers, and also by varying the total water flow through the chillers.

Various controllers for operating multiple chillers are also disclosed in the patent literature. For example, in U.S. Pat. No. 4,506,516 issued to Lord on Mar. 26, 1985, the use of a microprocessor is disclosed for operating multiple chillers, and in U.S. Pat. No. 4,463,574 issued to Spethmann et al. on Aug. 7, 1984, a controller is disclosed for optimally selecting a combination of chillers having dissimilar efficiency characteristics to efficiently meet a building's air conditioning load. Electric controller systems for efficiently operating air conditioning systems are also known, as for example in U.S. Pat. No. 4,147,296, issued to Spethmann on Apr. 3, 1979, which discloses an electric controller system for reducing and/or limiting a building's electrical power consumption by a proportional amount in order to prevent the power consumption from exceeding a predetermined demand limit; and in U.S. Pat. No. 5,946,926 issued to Hartman on Sep. 7, 1999, wherein a single-circuit, chilled fluid cooling system incorporates a variable flow chilled water distribution system to obtain stable operation at reduced variable flow rates of the circulating chilled fluid.

Finally, various approaches have been taken to compensate for low-load operation of a diesel engine generator onboard marine vessels. For example, load banks have been formulated whereby resistive load elements in the form of heating coils are inserted into a separately fabricated intake line coupled with a seawater pump to receive and discharge seawater from and to the vessel. Heating the seawater in this manner demands electrical power from the generator which in turn creates a load on the diesel engine powering the generator. In addition to requiring added space onboard the vessel, and the associated costs for assembling and incorporating the load bank into the vessel, the coils used to heat the seawater encounter calcification over a period of time due to the seawater's high mineral content. This results in the coils being coated with calcium and other minerals that quickly leads to the inability of the coils to transmit heat to the seawater. Consequently, the calcified coils become an added maintenance item in that they must be descaled by repeated acid washing, or simply replaced. Load banks utilizing this method of operation are available from a variety of sources, one of which is Simplx, Inc. of Springfield, Ill.

SUMMARY OF THE INVENTION

In accordance with a broader aspect of the invention, a system, apparatus and method is provided for maintaining an electrical load on a marine diesel engine generator utilizing the heat transfer fluid contained within the closed fluid circulation loop of marine vessel's chilled fluid air conditioning system. More specifically, a system is provided that comprises a closed-loop fluid air conditioning system for exchanging heat with the air in the vessel, comprising a first heat transfer means, e.g., one or more sources of heat transfer that comprises a chiller, reverse-cycle chiller or heat pump, preferably a plurality arranged in parallel relationship relative to each other, that receives therein and discharges therefrom a first heat transfer fluid, typically seawater, for ultimately exchanging heat with a second heat transfer fluid, generally water, a mixture of water and propylene glycol, or a mixture of water and ethylene glycol, the glycol component being present in an amount of from about 5 to about 25 percent by volume based on the total volume of the mixture. The second heat transfer fluid is supplied to and returned from the vessel within a closed circulation loop for exchanging heat with the air in the vessel.

The system additionally comprises a load bank comprising (i) controller means for diverting at least a portion of the second heat transfer fluid being supplied to the vessel, into heat exchange relationship with a third heat transfer fluid; and (ii) second heat transfer means, e.g., a heat exchanger, for exchanging heat between the diverted second heat transfer fluid and the third heat transfer fluid.

In a preferred embodiment of the invention, the third heat transfer fluid is the first heat transfer fluid in the form of seawater discharged from the first heat transfer means. Thus, the first heat transfer fluid will generally comprise seawater, although in another embodiment of the invention, the first heat transfer fluid will comprise seawater; and the third heat transfer fluid will comprise seawater provided to the second heat transfer means or heat exchanger independently of the seawater being received by the source of heat transfer.

Once heat-exchanged, the diverted second heat transfer fluid is returned to the first heat transfer means for activation thereof to create an electrical power demand on the diesel engine generator.

In another preferred embodiment of the invention, the diversion by the controller means of the portion of second heat transfer fluid being supplied to the vessel, is undertaken in response to a predetermined temperature value of the returning second heat transfer fluid, i.e., the second heat transfer fluid returning from the vessel after it has exchanged heat with the air in the vessel. In order to accomplish this, and in accordance with yet another embodiment of the invention, the controller means comprises at least one valve for admitting the diverted portion of second heat transfer fluid supply therethrough. In order to facilitate the diversion, it is preferential that the valve be operably coupled with a thermostat that is in temperature sensing relationship with the returning second heat transfer fluid. A plurality of valves and corresponding thermostats making up the controller means allows varying amounts of the second heat transfer fluid to be diverted to the second heat transfer means, e.g., a heat exchanger. Each of the valves is preferably operated in response to a thermostat setting reflective of the temperature of the returning second heat transfer fluid. As a further embodiment, each of the thermostats is in temperature sensing relationship with the returning second heat transfer fluid such that each of the valves is operated in response to a signal generated by its corresponding thermostat reflective of a predetermined temperature of the returning second heat transfer fluid detected upstream of its corresponding valve.

While not intending to exclude variations or other types, the heat exchanger may be of the plate, shell and tube, or tube and tube type heat exchanger, the plate type heat exchanger being preferred due to its relatively minimal space occupancy when incorporated into the system.

When the closed-loop fluid air conditioning system is used to cool the air in the vessel compartments, the source of heat transfer takes the form of either a chiller or reverse-cycle chiller. In larger vessels, a plurality of chillers or reverse-cycle chillers, or combinations thereof, are generally utilized, the chillers and/or reverse-cycle chillers being arranged in parallel relationship relative to each other. In order to assist in the heating of the returning second heat transfer fluid, the system may optionally comprise, in addition to the second heat transfer means or heat exchanger, one or more electrical resistant fluid heating devices in communication with the returning second heat transfer fluid for transferring heat thereto. The fluid heating device is preferably in the form of one or more electrically operated resistant water heaters, preferably a plurality arranged in parallel relationship relative to each other.

In another embodiment of the invention, and as an alternative to the use of a heat exchanger and valves for heating a diverted portion of the second heat transfer fluid when the closed-loop chilled fluid air conditioning system is used to cool the vessel air, the load bank may comprise a fluid heating means comprising one or more electrical resistant fluid heating devices operably coupled with a controller means for heating the second heat transfer fluid returning from the vessel to the source(s) of heat transfer in response to a predetermined temperature of the returning heat transfer fluid detected upstream of the fluid heating means. The fluid heating means comprises at least one electrically operated resistant water heater powered by the diesel engine generator. The controller means comprises at least one thermostat in temperature sensing relationship with the returning second heat transfer fluid. The load bank preferably comprises a plurality of electrically operated resistant water heaters, arranged in parallel relationship relative to each other, each water heater being powered by the diesel engine generator and operably coupled with and controlled by a corresponding thermostat in response to a thermostat setting reflective of a predetermined temperature of the returning second heat transfer fluid detected upstream of its corresponding water heater.

When the closed-loop fluid air conditioning system is used to heat the air in the vessel compartments, the source of heat transfer will take the form of either a reverse-cycle chiller or heat pump, preferably a plurality of reverse-cycle chillers or heat pumps, or combinations thereof, arranged in parallel relationship relative to each other. When the vessel is operating in very cold climate conditions, it will be appreciated that additional sources of heat may be required to heat the circulating second heat transfer fluid for supplying an adequate amount of heat to the vessel compartments. Therefore, in addition to the source(s) of heat transfer, the system may optionally comprise one or more electrical resistant fluid heating devices, powered by the diesel engine generator and preferably in the form of an electrically operated resistant water heater, in communication with the second heat transfer fluid being supplied to the vessel for heating the same.

Another embodiment of the invention includes a load bank for a marine diesel engine generator electrically coupled with a source of heat transfer in a closed-loop fluid air conditioning system that receives and discharges a primary heat transfer fluid for ultimately exchanging heat with a secondary heat transfer fluid, the secondary heat transfer fluid being supplied to and returned from the compartments of a marine vessel within a closed circulation loop for exchanging heat with the air in the vessel compartments, comprising (a) controller means for diverting at least a portion of the secondary heat transfer fluid supply into heat exchange relationship with a tertiary heat transfer fluid; and (b) a heat exchanger for exchanging heat between the diverted secondary heat transfer fluid and the tertiary heat transfer fluid; whereby the diverted, heat-exchanged, secondary heat transfer fluid is returned to the source of heat transfer for activation thereof to create an electrical power demand on the diesel engine generator for maintaining a load thereon. The primary, secondary and tertiary heat transfer fluids correspond respectively with the first, second and third heat transfer fluids of the system described above and include the various embodiments set forth for the first, second and third heat transfer fluids as part of the present load bank.

The controller means of the load bank comprises at least one valve which is usually operably coupled with a thermostat that is in temperature sensing relationship with the returning secondary heat transfer fluid from the vessel. When coupled with the thermostat, the valve is operated in response to a signal generated by the thermostat reflective of a predetermined temperature of the returning secondary heat transfer fluid detected upstream of the valve. In another embodiment, the load bank controller means comprises a plurality of valves and corresponding thermostats, the valves being arranged in parallel relationship relative to each other. As with the heat exchanger described for the system above, the heat exchanger of the load bank may be a plate type heat exchanger, a shell and tube type heat exchanger or a tube and tube type heat exchanger.

It will be understood that the closed-loop fluid air conditioning system according to the invention is not restricted to the use of a chiller, reverse-cycle chiller or heat pump for heating and/or cooling the circulating heat transfer fluid contained within the closed circulation loop. Instead, the closed-loop air conditioning system forming part of the system for maintaining an electrical load on a diesel engine generator for use on a marine vessel, may comprise (a) a fluid heating means, powered by the diesel engine generator, comprising at least one electrical resistant fluid heating device for heating a first heat transfer fluid being supplied to and returned from the vessel within a closed circulation loop for heating the air in the vessel. In this case, the first heat transfer fluid is the circulating heat transfer fluid contained within the closed circulation loop. The system for maintaining an electrical load on a diesel engine generator also comprises (b) a load bank comprising (i) controller means for diverting at least a portion of the first heat transfer fluid being supplied to the vessel, into heat exchange relationship with a second heat transfer fluid; and (ii) a heat exchanger for exchanging heat between the second heat transfer fluid and the diverted portion of the first heat transfer fluid whereby the heat-exchanged, diverted first heat transfer fluid is returned to the fluid heating means for activation thereof to create an electrical power demand on the diesel engine generator for maintaining a load thereon.

The first heat transfer fluid or circulating heat transfer fluid may comprise water, a mixture of ethylene glycol and water, or a mixture of propylene glycol and water, the glycols being present in their respective mixtures in an amount of from about 5 percent to 25 percent based on the total volume of the mixture. The second heat transfer will generally comprise seawater.

In this embodiment of the invention, the fluid heating means comprises at least one electrically operated resistant water heater, preferably a plurality arranged in parallel relationship relative to each other.

It is understood that the controller means and heat exchanger of the load bank for this embodiment of the invention correspond with the controller means and heat exchanger described hereinbefore. They also include the various embodiments of the previously described controller means and heat exchanger of the load bank associated with the use of a chiller, reverse-cycle chiller or heat pump as part of the closed-loop fluid air conditioning system.

The invention also encompasses a method for maintaining a load on the diesel engine generator onboard a marine vessel utilizing the circulating heat transfer fluid contained within the closed circulation loop of a fluid air conditioning system to exchange heat with the air in the vessel, comprising (a) transporting a primary heat transfer fluid through a first heat transfer means of the closed circulation loop fluid air conditioning system for ultimately exchanging heat with the circulating heat transfer fluid; (b) supplying and returning the circulating heat transfer fluid in the closed circulation loop to and from the vessel, respectively, for heat exchange with the air therein; (c) diverting at least a portion of the circulating heat transfer fluid being supplied to the vessel, into heat exchange relationship with a tertiary heat transfer fluid; and (d) returning the diverted, heat-exchanged circulating heat transfer fluid to the first heat transfer means whereby the first heat transfer means is activated to create an electrical power demand on the diesel engine generator for maintaining a load thereon. In accordance with the method, the first heat transfer means may comprise a chiller, reverse-cycle chiller or heat pump, preferably a plurality of chillers, reverse-cycle chillers or heat pumps, or combinations thereof, arranged in parallel relationship relative to each other.

The portion of circulating heat transfer fluid being supplied to the vessel is preferably diverted in response to a predetermined temperature value of the returning primary heat transfer fluid, usually by a controller means comprising at least one valve. As a preference, the valve is operably coupled with a thermostat that is in temperature sensing relationship with the returning circulating heat transfer fluid, the valve being operated in response to a thermostat setting reflective of the temperature of the returning circulating heat transfer fluid which is detected upstream of the valve. In order to more effectively control the actuation of the sources of heat transfer, the controller means will generally comprise a plurality of valves and corresponding thermostats, the valves being arranged in parallel relationship relative to each other.

The heat exchange of the diverted portion of circulating heat transfer fluid and primary heat transfer fluid is generally undertaken by a second heat transfer means comprising a heat exchanger which may be a plate type heat exchanger, a shell and tube type heat exchanger, or a tube and tube type heat exchanger.

The primary and tertiary heat transfer fluids correspond respectively with the first and third heat transfer fluids of the system described above and include the various embodiments set forth for the first and third heat transfer fluids as part of the present method. The circulating heat transfer fluid may comprise water, a mixture of ethylene glycol and water, or a mixture of propylene glycol and water, the glycol component being present in its respective mixture in an amount of from about 5 to 25 percent based on the total volume of the mixture.

Also encompassed by the invention is a method for maintaining a load on a diesel engine generator onboard a marine vessel utilizing the circulating heat transfer fluid contained within the closed circulation loop of a chilled-fluid air conditioning system comprising at least one chiller or reverse-cycle chiller, the method comprising (a) supplying and returning the heat transfer fluid in the closed circulation loop to and from the vessel, respectively, for cooling the air therein; (b) heating the heat transfer fluid returning from the vessel to the chiller or reverse-cycle chiller; and (c) returning the heated heat transfer fluid to the chiller or reverse-cycle chiller for activating the same to create an electrical power demand on the diesel engine generator for maintaining a load thereon. The heat transfer fluid is preferably heated with at least one electrical resistant fluid heating device such as an electrically operated resistant water heater, preferably in response to a predetermined temperature value of the returning heat transfer fluid. The operation of the fluid heating device is desirably controlled by a thermostat in temperature sensing relationship with the returning heat transfer fluid upstream of the fluid heating device. In order to control the temperature of the returning heat transfer fluid for activating the chiller or reverse-cycle chiller, it is preferred that the returning heat transfer fluid be heated by a plurality of resistant water heaters, each water heater being operably controlled by a corresponding thermostat in response to a thermostat setting reflective of a predetermined temperature of the returning heat transfer fluid detected upstream of the resistant water heaters.

BRIEF DESCRIPTION OF THE DRAWINGS

A complete understanding of the invention may be obtained by reference to the following specification when taken in conjunction with the accompanying drawings wherein certain preferred embodiments are illustrated and wherein like numerals refer to like parts throughout. Thus.

DETAILED DESCRIPTION OF THE INVENTION AND PREFERRED EMBODIMENTS THEREOF

The present invention provides a system, apparatus and method for creating and maintaining an electrical load on a marine diesel engine generator of a seafaring vessel utilizing the vessel's closed loop, fluid air conditioning system. The present system takes advantage of an existing network already in place onboard seafaring vessels with minor modifications to the network's structure for implementing and creating an electrical power load for a marine diesel engine generator. Substantial economical costs are derived from the invention over those apparatus and systems that employ separate load banks.

Figure 1:
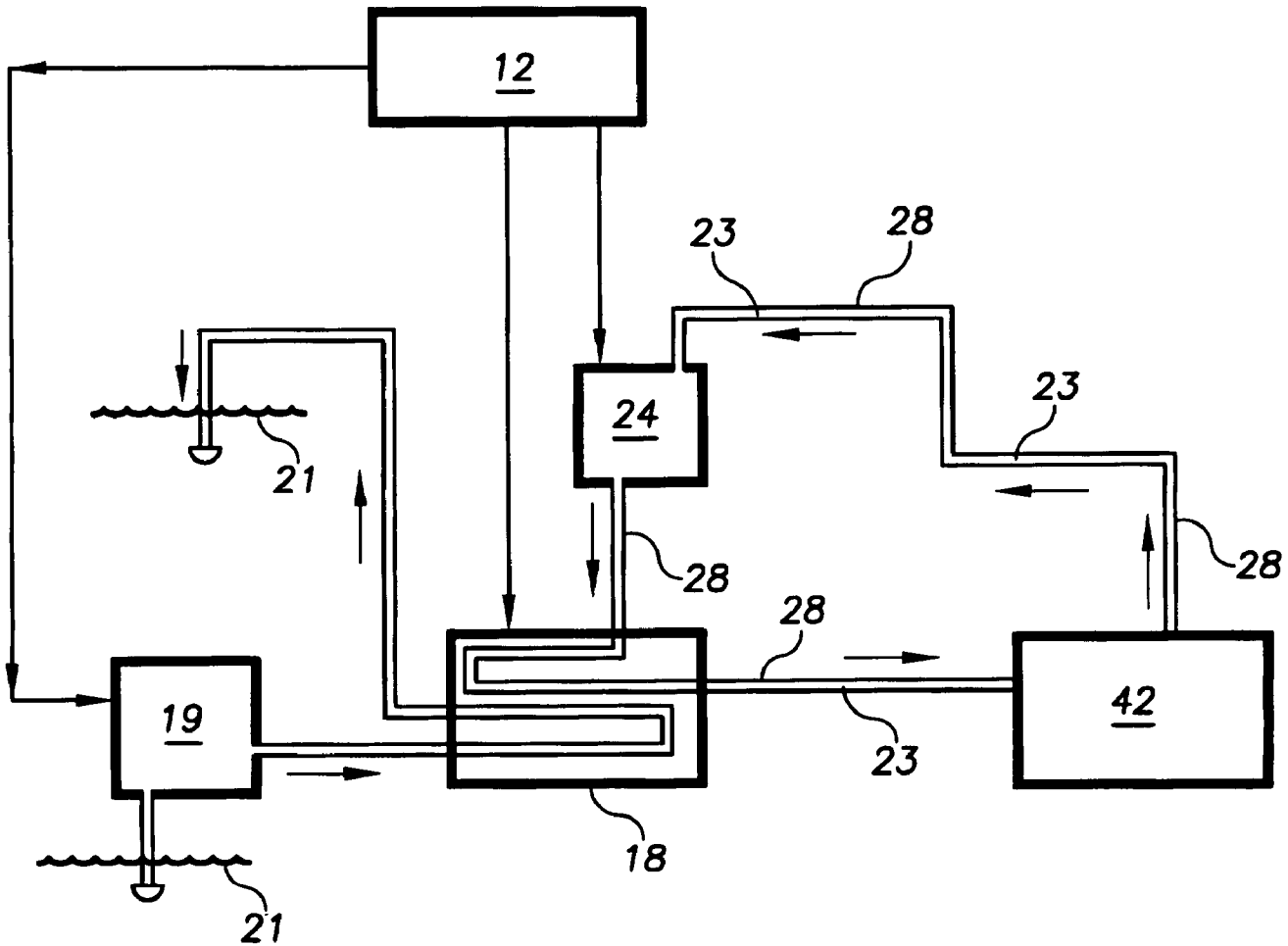
FIG. 1 is a block diagram of a conventional, closed loop, chilled water air conditioning system used onboard a marine vessel.
Figure 2:
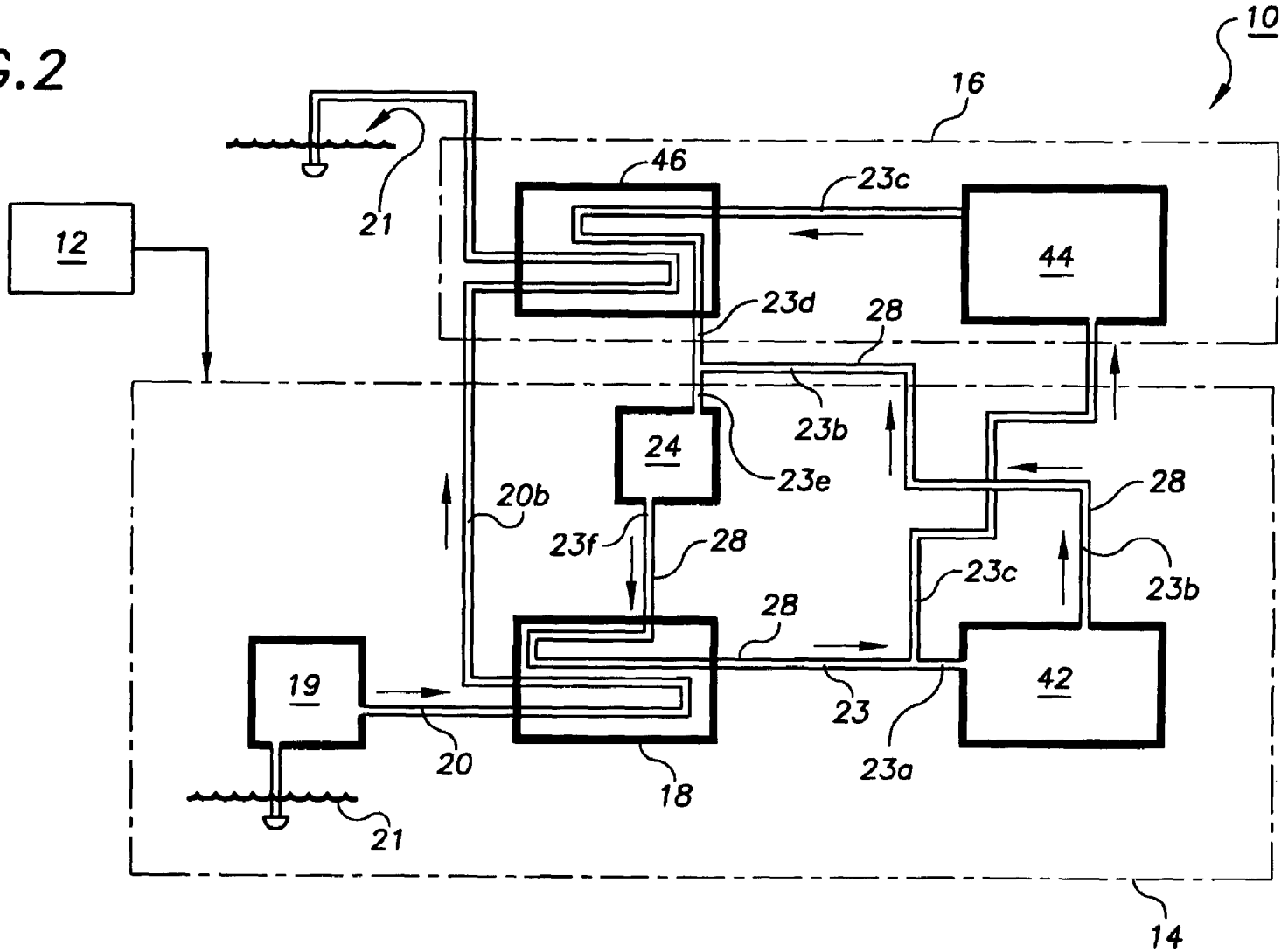
FIG. 2 is a block diagram of a combined closed loop, fluid air conditioning system and load bank for use onboard a marine vessel in accordance with one embodiment of the invention.

Referring now to FIG. 2, there is shown for illustrative purposes only, a block diagram representing, in one embodiment of the invention, a system 10 for creating and/or maintaining an electrical load on a marine diesel engine generator 12 utilizing an integrated closed loop fluid air conditioning system 14 and a load bank 16. More specifically, a diesel engine-powered generator 12 is provided for supplying electrical power to a closed loop, fluid air conditioning system 14. Air conditioning system 14 comprises at least one source of heat transfer 18 in the form of, for example, a chiller, reverse-cycle chiller or heat pump, that receives and discharges a first heat transfer fluid 20, typically seawater. For the purposes of this invention, the term "source of heat transfer" is used as a generic term for describing a chiller, reverse-cycle chiller and/or a heat pump as those devices are known in the air conditioning industry. First heat transfer fluid 20 is arranged in heat exchange relationship with a second heat transfer fluid 23, which is generally fresh water, for ultimately exchanging heat between the seawater and fresh water. Second heat transfer fluid 23 is transported from the source of heat transfer 18 by means of pump 24 to one or more air handlers located in the various compartments of the vessel (represented by diagram box 42), and returned back to the source of heat transfer 18 within a closed circulation loop 28 after exchanging heat with the air in the vessel compartments.

System 10 additionally comprises a load bank 16 that includes a controller 44 for diverting a portion 23*c* of the second heat transfer fluid 23 into heat exchange relationship with the first heat transfer fluid 20*b* discharged from the source of heat transfer 18, preferably in response to a predetermined temperature value of the returning second heat transfer fluid 23*b* exiting air handlers 42. Heat exchange between the first and second heat transfer fluids 20*b* and 23*c*, respectively, is undertaken by heat exchanger 46. When the diverted heat-exchanged second heat transfer fluid 22*d*, combined with the remaining heat transfer fluid 23*b* exiting air handlers 42 (the combination of the two being represented by reference numeral 23*e*) is returned to circulating pump 24 and introduced once again to the source of heat transfer 18, the source of heat transfer is activated in response to a demand for temperature-conditioned air in the vessel compartments. Thus, when activated, the source of heat transfer will exchange heat with the incoming second heat transfer fluid 23*f* to satisfy the air temperature conditions required by the vessel's compartments. As a result, an electrical power demand is placed on generator 12 for operating the source of heat transfer 18. The additional load placed on generator 12 by load bank 16 creates a means whereby a load on the diesel engine, utilizing the closed loop heat transfer fluid of the vessel's air conditioning system, can be assured to avoid low-load or no-load operation of the engine.

Figure 3:
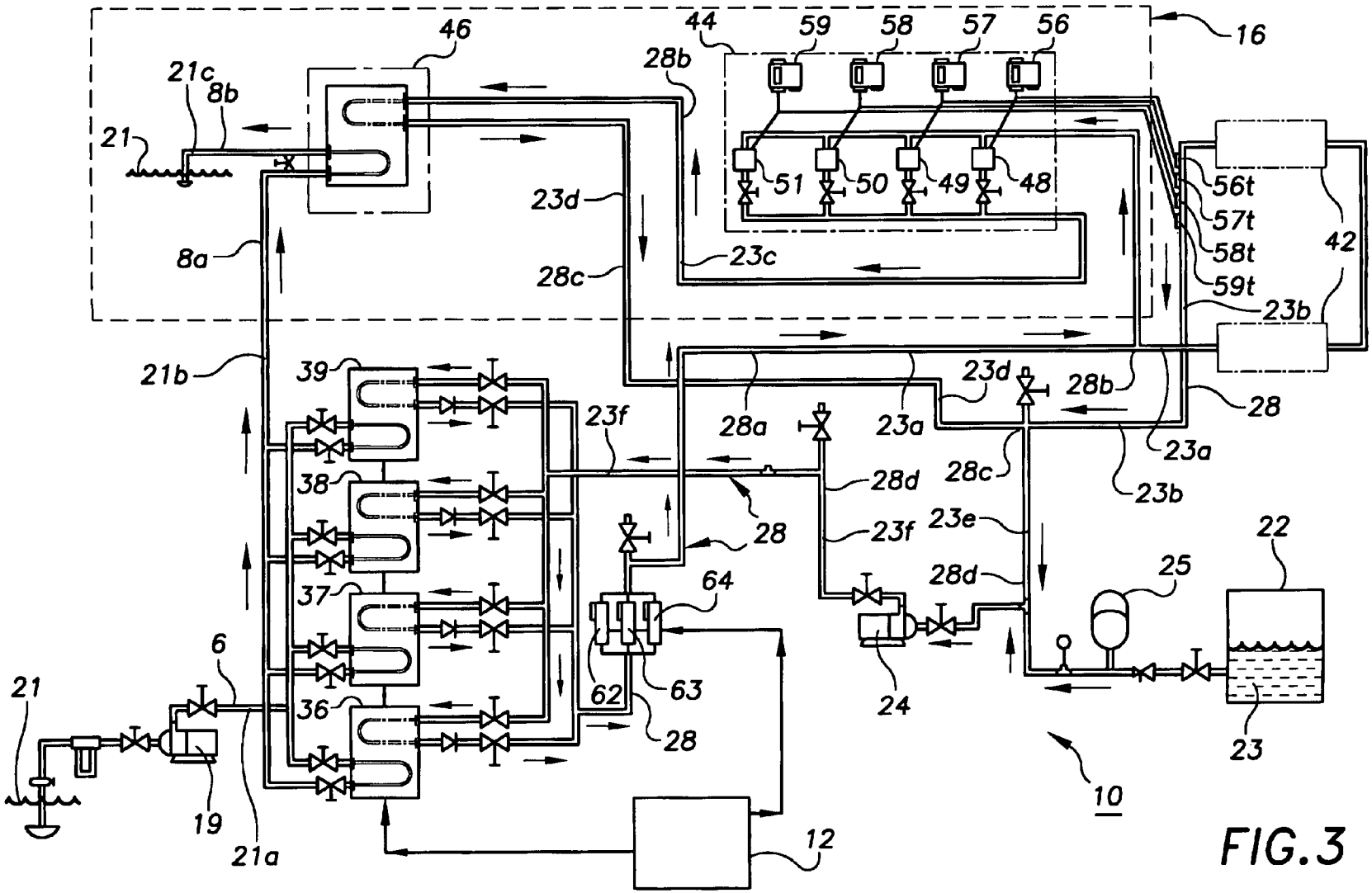
FIG. 3 is a schematic diagram of a combined closed loop, fluid air conditioning system and load bank for use onboard a marine vessel in accordance with another embodiment of the invention.

Referring now to FIG. 3, and in accordance with another embodiment of the invention, the system illustrated in FIG. 2 is augmented in that the air conditioning system 14 comprises a plurality of sources of heat transfer 34,35,36,37 (referred to hereinafter as "heat transfer sources") arranged in parallel relationship relative to each other, each of which is configured to receive a first heat transfer fluid 20 in the form of seawater 21 via the action of seawater pump 19. For purposes of describing the invention, it will be understood that each of reference numerals 34,35,36,37 can represent and include chillers, reverse-cycle chillers, or heat pumps, or combinations thereof, depending on whether the air conditioning system is being used to cool or heat the vessel air. Accordingly, when cooling of the vessel is required, the source of heat transfer can include a chiller or reverse-cycle chiller, the former being provided with a reversing valve (not shown) for transforming the chiller into a reverse-cycle chiller which has the dual capability of acting as a chiller or heat pump. And when heating of the vessel air is necessitated, the source of heat transfer may include a reverse-cycle chiller or heat pump.

The seawater 21*a* pumped to and from heat transfer sources 34,35,36,37 by the action of seawater pump 19 via inlet conduit 6 and discharge conduit 8, is arranged in heat exchange relationship with a refrigerant within the heat transfer sources for ultimately exchanging heat with the second heat transfer fluid 23 by means of a condenser, evaporator and compressor (not shown) as is well known in the air conditioning art. The second heat transfer fluid 23, which is typically in the form of circulating water 23*f*, is transported through the heat transfer sources by circulating pump 24. In this manner, heat transfer sources 34,35,36,37 of air conditioning system 14 are capable of supplying a chilled or heated circulating fluid 23 to closed circulation loop 28, depending on whether cooling or heating of the vessel is required.

As further illustrated in FIG. 3, circulating water 23 is supplied to circulation loop 28 from a fresh water supply 22 through expansion tank 25. Fresh water supply 22 also serves the function of replenishing the water in circulation loop 28 when, for example, moisture loss occurs, e.g., due to water leakages in the closed loop system, etc.

It will be understood that the second heat transfer fluid, in addition to water, may also comprise the inclusion of other additives, in particular a mixture of ethylene glycol and water, or a mixture of propylene glycol and water, the glycol component being present in its respective mixture in an amount of from about 5 percent to about 25 percent, based on the total volume of the mixture. When water is used as the second heat transfer fluid, it usually has the glycol component added to it for a variety of reasons, chief among them being that the ethylene or propylene glycol acts as a lubricant for the internal moving components that the closed circulation loop 28 comes in contact with. The glycol component also serves as a safeguard for the chiller, reverse-cycle chiller and heat pump to prevent them from freezing up during cold climate operating conditions.

Once heated or cooled by any or all of heat transfer sources 34,35,36,37, circulating water 23*a* is pumped and distributed, via conduit 28*a*, to the various compartments of the vessel by means of, for example, an arrangement of air handlers represented by reference numeral 42, the details of which are commonly known in the air conditioning industry and are therefore not illustrated herein. After being supplied to air handlers 42, the heated or chilled circulating water 23*a* is transported to each of the vessel compartments which contain a series of coils equipped with motor driven fans (not shown) for exchanging heat with the respective compartment air and circulating water 23*a*. The heat-exchanged circulating water 23*b* is then transported back to heat transfer sources 34, 35, 36, 37 via the action of pump 24 where it is cooled or heated once again to complete a continuous air conditioning cycle.

In order to create and/or maintain an electrical load on generator 12 utilizing the vessel's air conditioning system 14 illustrated in FIGS. 2 and 3, system 10 includes a load bank 16 that comprises, in one embodiment of the invention, a controller means in the form of, for example, load bank controller 44 and a load bank heat transfer means in the form of heat exchanger 46. Controller 44 comprises a means for diverting the circulating water, for example, at least one water valve, preferably a plurality of valves (designated by reference numerals 48,49,50,51), for admitting therethrough a portion of the pressurized circulating water 23*a* being supplied to air handlers 42. The diverted portion of circulating water, indicated by the direction of arrows in FIG. 3, is represented by reference numeral 23*c*. Once any or all of valves 48,49,50,51 are opened, circulating water 23*c* is transported through conduit 28*b* to load bank heat exchanger 46 by the action of circulating pump 24. As the circulating water 23*c* enters heat exchanger 46, it is subjected to heat exchange with the seawater 21*b* exiting any or all of heat transfer sources 34,35,36,37 via conduit 8*a*. After exchanging heat with circulating water 23*c*, the seawater 21*c* exiting heat exchanger 46 is returned to the sea 21 via conduit 8*b*.

Figure 5:
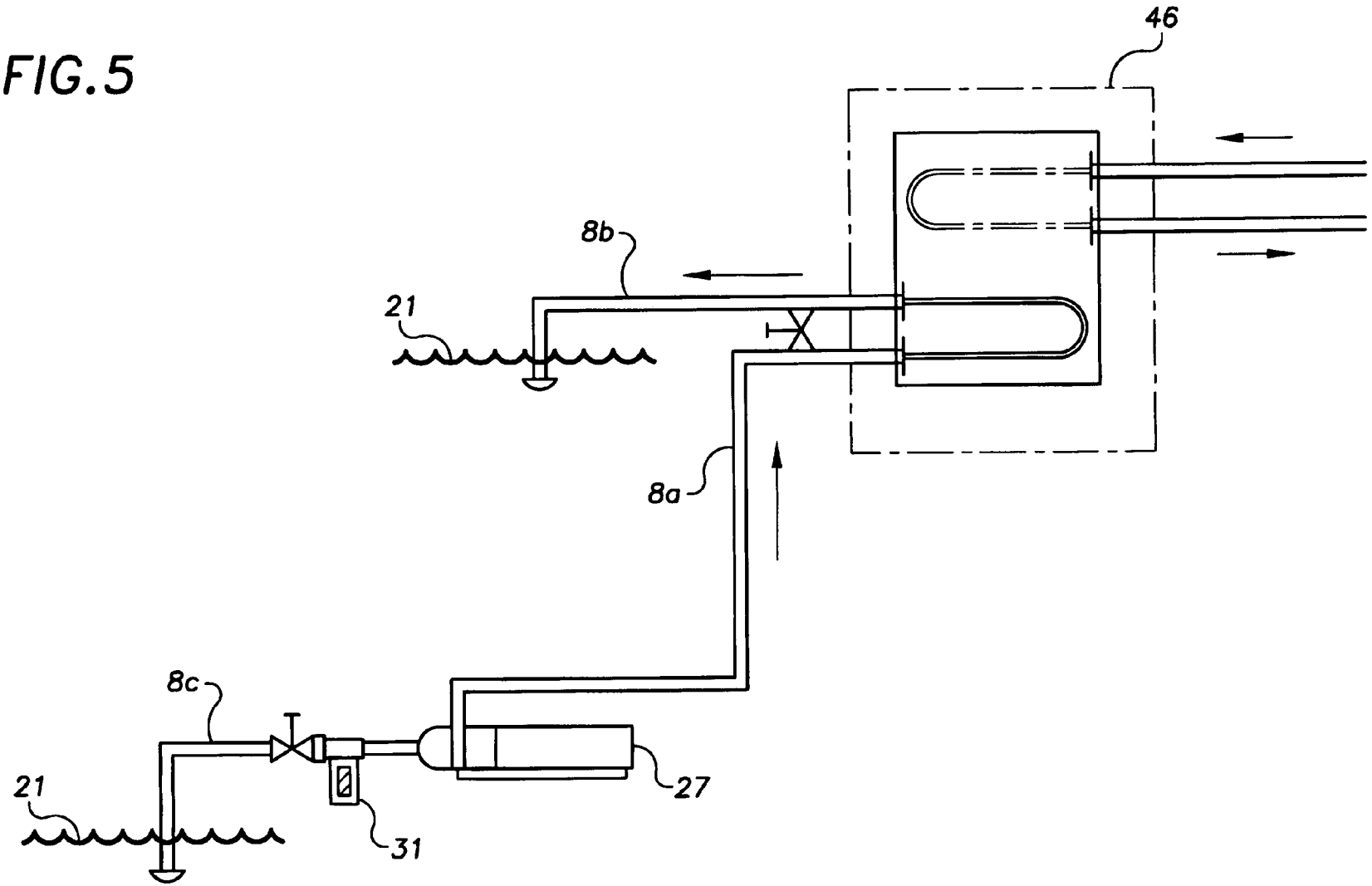
FIG. 5 is a schematic diagram of the load bank heat exchanger 46 shown in FIG. 3 in accordance with another embodiment of the invention.

It will be understood that the load bank is not restricted to the sole use of seawater 21*b* exiting any one or all of heat transfer sources 34,35,36,37 for exchanging heat with circulating water 23*c*. Heat exchanger 46 can receive and discharge a heat exchange fluid from other sources, for example seawater directly from the sea. As shown in FIG. 5, this is accomplished by providing a separate seawater pump 27 that draws seawater 21 from the sea via conduit 8*c* through strainer 31 into conduit 8*a* disposed between pump 31 and heat exchanger 46. As seawater 21 is pumped through heat exchanger 46, heat is exchanged with circulating water 23*c* entering the heat exchanger.

The heat-exchanged circulating water exiting heat exchanger 46, designated by reference numeral 23*d*, is returned to closed circulation loop 28 via conduit 28*c* and combined with the remainder of circulating water 23*b* exiting air handlers 42. The combined circulating water 23*e* is then fed to circulating pump 24 and transported as circulating water 23*f* to any or all of heat transfer sources 34,35,36,37 under the action of circulating pump 24. Once received into the respective heat transfer sources 34,35,36,37, the heat transfer sources are activated thereby creating an electrical power demand on generator 12. The diversion of a portion of the circulating water being supplied to air handlers 42, into heat exchange with the seawater 8*b* exiting heat transfer sources 34,35,36,37, therefore acts as a load bank for creating an electrical power demand on generator 12 which in turn relieves low-load or no-load operation of the diesel engine.

Any conventional type of heat exchanger can be used for exchanging heat between circulating water 23*c* and seawater 21*b* depending on a variety of factors, primarily space availability onboard the vessel. Other factors include cost, design, and the materials making up the heat exchanger. While the invention is not deemed to be restricted to any particular kind of heat exchange apparatus, plate frame, tube-in-tube and shell-and-tube are examples of heat exchangers that can be used. A plate frame heat exchanger is preferred because it satisfies the economy of space requirement usually prevalent onboard marine vessels.

The diversion of circulating water 23*c* to heat exchanger 46 can be undertaken by any conventional means. For example, the diversion of circulating water 23*c* through any or all of valves 48,49,50,51 may be accomplished by manually operating the valves under circumstances when the diesel engine is experiencing low-load or no-load conditions. The operation of the valve(s), however, is preferably undertaken automatically, for example, by coupling each of the valves with an electric motor (not shown) to open and close the valve for admitting or denying water therethrough. In the air conditioning industry, these types of valves are referred to as motorized water valves which generally employ an electric motor for actuating a lever on the valve that in turn displaces a plunger from a seat overlying a port within the valve. When the lever is actuated by the electric motor and the plunger lifted, water will be admitted through the valve. The electric motor is capable of reversing the lever for the return of the plunger to its seat thereby denying water flow through the valve. Other means for automatically diverting a portion of circulating water 23*a* from its closed circulating loop 28 include, but are not limited to, electrically, pneumatically or hydraulically operated solenoid valves and any other valves commonly employed in the air conditioning industry for passing fluids therethrough.

Each of valves 48,49,50,51 is electrically coupled with, via their corresponding electric motors (not shown), temperature control means in the form of thermostats 56,57,58,59, respectively, the thermostats being capable of sensing the temperature of the returning circulating water 23*b* from the vessel's air handlers 42 with temperature sensing devices 56*t*,57*t*,58*t*,59*t*. In the embodiment illustrated in FIG. 3, the temperature sensing devices are located at a point where the returning circulating water 23*b* leaves air handlers 42, but generally may be located at any point in circulation loop 28 between air handlers 42 and load bank controller 44. Thermostats 56,57,58,59 are also capable of generating and transferring an electrical signal to their respective electric motors reflective of a predetermined temperature setting for the returning circulating water 23*b*. Once the signal from any one of thermostats 56,57,58,59 is received by its corresponding electric motor, corresponding valves 48,49,50,51 are either opened or closed depending on the temperature setting programed into the corresponding valve's thermostat. For example, as shown in FIG. 3, if valve 48 is opened, circulating water 23*c* is diverted from circulating water 23*a* into conduit 28*b* of circulation loop 28 before circulating water 23*a* enters the vessel compartment air handlers 42. In similar fashion, the respective valve will close when the temperature of the returning circulating water 23*b* matches the temperature setting programed into the corresponding thermostat for generating and transmitting an electrical signal to the motorized valve for closing the valve.

Operation of system 10 for maintaining an electrical load on marine diesel engine generator 12 when the air conditioning system 14 is used to cool the marine vessel will now be described. When the seafaring vessel is operating under warm weather conditions, the daytime temperatures will be such that all of heat transfer sources 36,37,38,39 of the air conditioning system will be online to cool the various compartments of the vessel. In this example, heat transfer sources 36,37,38,39 will necessarily take the form of chillers or reverse-cycle chillers, or combinations thereof, and in the following description, will be collectively referred to as "chillers."

Chillers 36,37,38,39 are operated by having seawater 21 transported to them via conduit 6 by the action of seawater pump 19, and after circulating through the chillers, seawater 21*b* is discharged therefrom via conduit 8*a*. The seawater discharged from each of chillers 36,37,38,39 takes with it the heat absorbed from circulating water 23*f* via the refrigerant used in conjunction with each of the chiller's condenser, evaporator and compressor. Once circulating water

23*f* is cooled by chillers 36,37,38,39, the water (designated by reference numeral 23*a*) is circulated by the action of circulation pump 24 to the vessel's air handlers 42 where heat from the air in the respective compartments of the vessel is absorbed by the circulating water. The returning heated circulation water 23*b* is then rerouted back to pump 24 where it is then pumped to chillers 36,37,38,39 for cooling once again.

As the air temperature of the vessel begins to drop during the evening hours and the heat load of the vessel gradually decreases, the chillers of the air conditioning system will begin to stage off one by one. For example, during the daytime, the climate air temperature may be 85° F. (or about 29.4° C.), thus requiring all of chillers 36,37,38,39 to be online to cool and maintain the vessel compartments at an average temperature of 72° F. (or about 22.2° C.). When the climate air temperature starts to decline during the evening hours, and assuming all of chillers 36, 37, 38, 39 are still on-line and in operation, the temperature of circulating water 23*b* returning from the vessel's air handlers 42 will begin to drop. During this period of time lasting into the night, chillers 39,38 and 37 will shut down one by one because it will take less cooling of the circulation water 23 to maintain the vessel's compartments at a temperature of 72° F. (or about 22.2° C.). Eventually, when the temperature of the returning circulating water 23*b* reaches, for example, 52° F. (or about 11.1° C.), it will only be necessary to operate chiller 36 to maintain the prescribed air temperature of the vessel compartments. It is during this time that the electrical demand on generator 12 will be such that its diesel engine will be operating under low-load conditions.

In order to maintain a sufficient electrical load on diesel engine generator 12 during these types of conditions, e.g., when only one or two of the chillers is in operation, load bank 16 is employed. Referring to FIG. 3 once again, when the temperature of the circulating water 23*b* returning from the vessel's air handlers 42 reaches a predetermined temperature of, for example, 54° F. (or about 12.2° C.), temperature sensing device 56*t* will transmit a signal to corresponding thermostat 56 that in turn transmits a signal to the electric motor (not shown) of valve 48 for opening the valve. The opened valve has the effect of diverting a portion of circulating water 23*c* (which is under pressure by virtue of circulating pump 24) from circulation loop 28 through conduit 28*b*. If the temperature of returning circulating water 23*b* reaches a lower temperature of, for example 53° F. (or about 11.7° C.), then thermostat 57, which has been programmed to open valve 49 at that temperature, will transmit an electrical signal from temperature sensing device 57*t* to its corresponding electric motor (not shown) for opening valve 49. This has the effect of admitting an increased portion of circulating water 23*c* from conduit 28*a* of circulation loop 28. Valves 50 and 51 will open in a similar fashion when their corresponding temperature sensing devices 58*t* and 59*t* detect a temperature of, for example, 52° F. (or about 11.1° C.) and 51° F. (or about 10.6° C.), respectively, thereby diverting a greater portion of circulating water 23*c* from circulation loop 28.

Once diverted, the circulating water 23*c* exiting any of valves 48,49,50,51 is passed to load bank heat exchanger 46 via conduit 28*b* where it is heat exchanged with, or in this case, absorbs the heat from, the heated seawater 21*b* entering the heat exchanger from chillers 36,37,38,39 via discharge conduit 8*a*. Seawater 21*c*, having transferred its heat to circulating water 23*c*, exists heat exchanger 46 and is returned back to the sea via conduit 8*b*. As shown in FIG. 3, once circulating water 23*c* is heated by seawater 21*b*, the exiting circulating water 23*d* from heat exchanger 46 is returned to circulation loop 28 via conduit 28*c* where it joins the remainder of circulation water 23*b* for entry into circulation pump 24 as circulating water 23*e*. As a result, the temperature of the combined circulating waters 23*b* and 23*d* as they leave pump 24, referenced by numeral 23*f*, will be increased to approximately 54° F. (or about 12.2° C.), thereby imparting a greater heat load on chiller 36. The added heat load carried by circulating water 23*f* will trigger the activation of chiller 37 to produce a supply of chilled circulating water 23*a* at a temperature of 48° F. (or about 8.9° C.) for maintaining the 72° F. (or about 22.2° C.) air temperature demanded by the vessel compartments. The remainder of chillers 38 and 39 will be activated in a similar fashion when the temperature of circulating water 23*b* drops to the predetermined temperature programmed into their corresponding thermostats 58 and 59. The activation of chillers 37,38 and/or 39 to cool the increased heat load carried by circulating water 23*f* will therefore place a greater electrical load on generator 12, and as a result, will contribute to maintaining a sufficient load on the diesel engine in order to avoid the deleterious effects of low-load operation.

It will be understood that the temperature settings of the various thermostats 56,57,58,59 can be set or varied to accommodate the heat load conditions in the vessel compartments and control the number of chillers to be activated. For example, the settings for each of thermostats 56,57,58, 59 can be varied by increments of greater than one degree to accommodate the capacity and operating parameters of chillers 34,35,36,37. Moreover, in addition to setting the thermostats for actuating the chillers in stages, they can be programmed at the same or similar temperature settings so that two or more of the chillers can be simultaneously activated for coming on line. The load bank apparatus according to the invention therefore offers a wide degree of latitude for controlling the operation of the chillers to create and maintain an electrical load on diesel engine generator 12.

When circumstances warrant the heating of the vessel compartments, the air conditioning system 14 of system 10 will operate to supply heat to the vessel compartments. For the purposes of the following example and description, it is assumed that heat transfers sources 36,37,38,39 are reverse-cycle chillers or heat pumps, or combinations thereof, both of which will be collectively referred to as "heat pumps." The operation of a reverse-cycle chiller or heat pump is well known to those skilled in the air conditioning industry and their brief description for heating the circulating water in a conventional closed-loop air conditioning system is presented under the "Background Of The Invention" heading set forth herein. Heat pumps 36,37,38,39 use the heat of seawater 21 transported therethrough to heat the circulating water 23 in air conditioning system 14.

By way of example and for purposes of illustration, the heating demand for the vessel will be the greatest during the evening hours, with all of the heat pumps 36,37,38,39 being online to maintain an average temperature in the vessel compartments at, for example, 75° F. (or about 23.9° C.). The electrical power demand on generator 12 will therefore be sufficient for maintaining an adequate load on its diesel engine. During the early daytime hours, however, the climate air temperature will gradually increase and the heating demand for the vessel will be somewhat reduced. As the middle of the day is reached, the reverse cycle chillers will stage off one by one until only one heat pump 36 is needed to meet the heating demands of the vessel compartments. For example, when the temperature of circulating water 23*b* increases to 130° F. (or about 54.4° C.), it will be sensed by temperature sensing device 56*t* and cause thermostat 56 to activate valve 48 into the open position, assuming a thermostat temperature setting of 130° F. (or about 54.4° C.). The opening of valve 48 will admit therethrough a portion of circulating water 23*c* and allow transport of the same to heat exchanger 46 via conduit 28*b* where it is cooled by the chilled seawater 21*b* exiting, for example, heat pump 36.

Once cooled, circulating water 23*d* is returned to circulation loop 28 where it is combined with circulating water 23*b* for introduction to pump 24 as circulating water 23*e*. The chilled circulating water 23*f* leaving pump 24 will have a temperature of approximately 120° F. (or about 48.9° C.), which in turn will cause heat pump 37 to be activated for providing additional heat to circulating water 23*f*, to maintain vessel compartments at the temperature requirement of 75° F. (or about 23.9° C.). The activation of heat pump 37 will create an additional electrical demand on generator 12, thereby increasing the load on the diesel engine powering the same.

As the temperature of circulating water 23*b* increases to sequential temperatures of, for example, 132° F. (or about 55.6° C.) and 134° F. (or about 56.7° C.), valves 38 and 39 will be activated, respectively, into the open position by their corresponding thermostats 58 and 59 to admit therethrough additional amounts of circulating water 23*c* for cooling by heat exchanger 46 with seawater 21*b*. The additional load created by the diversion and cooling of circulating water 23*c* will create a corresponding demand on heat pumps 38 and 39 to provide a supply of heated circulating water 23*a* to air handlers 42. As a result, a correspondingly greater electrical power demand will be placed on generator 12 as the activation of heat pumps 38 and 39 is initiated.

It will be appreciated that the effectiveness of heat pumps 36,37,38,39, whether they be reverse-cycle chillers or heat pumps, will, for practical considerations, be economical and efficient only when operating in seawater temperatures above 48° F. (or about 8.9° C.). The rationale is that as the seawater temperature approaches freezing temperatures, the seawater will be devoid of sufficient heat for transference to circulating water 23. For this reason, it is more economical and practical to use other or additional forms of apparatus for heating the circulating water, either in conjunction with heat pumps 36,37,38,39, or in lieu thereof. Therefore, as shown in FIG. 3, one or more fluid heating devices in the form of, for example, electrical resistant fluid heating devices such as in-line resistant water heaters 62,63,64 powered by diesel engine generator 12, are provided. The fluid heating devices are arranged in parallel relationship with respect to each other in conduit 28*a* of circulation loop 28. The advantage to using in-line water heaters is that they offer an added economical capacity advantage due to their minimal space occupancy. When used in place of heat pumps 36,37,38,39, the heat pumps are turned off. When used to complement heat pumps 36,37,38,39, the seawater discharge 21*b* continues to heat exchange the circulating water 23*c* via heat exchanger 46 for maintaining the appropriate activation of heat pumps 36,37,38,39 and heating devices 62,63,64. In this way, an electrical demand will continue to be placed on generator 12 under otherwise low-load conditions. It will be appreciated that the use of fluid heating devices other than heat pumps 36,37,38,39, such as electrical resistance water heaters, are optional and are usually used in very cold climate conditions, for example when the seawater temperature is below about 48° F. (or about 8.9° C.)

Whether the air conditioning system 14 is used to cool or heat the vessel, circulating water 23*c* can be heat exchanged with seawater from a source other than from the discharge of heat transfer sources 36,37,38 and/or 39. As illustrated in FIG. 5 and as indicated hereinbefore, seawater 21 can be introduced from the sea to heat exchanger 46 by utilizing a separate conduit 8*c* and seawater pump 27 for circulating the seawater (or any other functional fluid for the intended purpose) through the heat exchanger.

Figure 4:
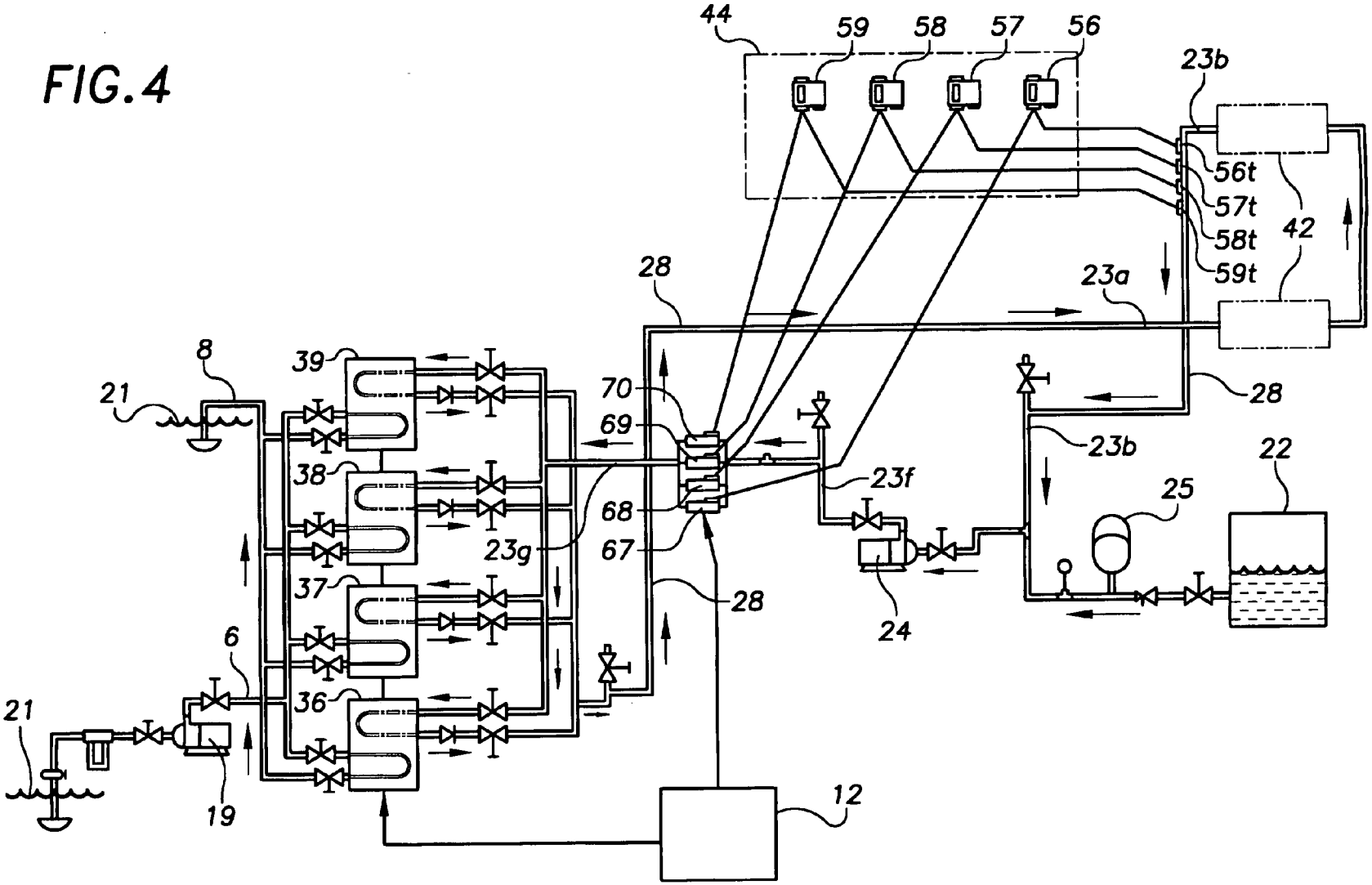
FIG. 4 is a schematic diagram of a combined closed loop, chilled water air conditioning system and load bank for use onboard a marine vessel in accordance with yet another embodiment of the invention.

As an alternative to the use of load bank heat exchanger 46 in load bank 16, one or more fluid heating devices other than chillers 36,37,38,39 may be utilized when air conditioning system 14 is used to cool the vessel compartments. FIG. 4 illustrates such a system wherein all components that are identical with or clearly analogous to the corresponding part of the system shown in FIGS. 2, 3 and 5 are denoted by similar reference characters. Referring now to FIG. 4, and in accordance with another embodiment of the invention, fluid heating devices in the form of electrical resistant fluid heating devices, such as in-line electrical resistant water heaters 67,68,69,70, are provided in the return segment of circulation loop 28, the return segment being that section of circulation loop 28 in which the circulation water 23*b* is returned from the vessel air handlers 42 back to chillers 36. In-line resistant water heaters 67,68,69,70 comprise an electrically operated coil placed in the path of the circulating water 23 for heating the same by supplying electrical power to the coil. Resistant water heaters 67,68,69,70 are preferably placed at a point in the water circulation loop prior to the entry of circulating water 23*f* to chillers 36,37,38,39.

As indicated above, resistant water heaters 67,68,69,70 act as a replacement for electrically operated valves 56,57, 58,59 and heat exchanger 46 for implementing the load bank according to the invention herein. Each of resistant water heaters 67,68,69,70 are electrically coupled with thermostats 56,57,58,59, respectively, within load bank controller 44, and being powered by diesel engine generator 12, act in concert with chillers 36,37,38,39 to increase the electrical load capacity placed on the generator. Consistent with this aspect of the invention, the load bank controller 44 comprises thermostats 56,57,58,59 and their corresponding temperature sensing devices 56*t*,57*t*,58*t*,59*t*. As with the embodiment illustrated in FIG. 3, the temperature sensing devices are disposed in circulating water 23*b*, preferably at a point in the circulation loop 28 where the circulating water 23*b* exits the vessel's air handlers 42 prior to its entry to water circulation pump 24.

In operation, when the temperature of the circulating water 23*b* returning from the vessel's air handlers 42 reaches a predetermined temperature, for example, 56° F. (or about 13.3° C.), temperature sensing device 56*t* will transmit a signal to its corresponding thermostat 56 that in turn will transmit a signal to resistant water heater 67 for activation of the same. Water heater 67, which also derives its power from diesel engine generator 12, will then heat the circulating water 23*f* entering the heater for return to any one or more of chillers 36,37,38,39. The circulation water exiting resistant water heaters 67,68,69,70 is identified as reference numeral 23*g* in FIG. 4. Furthermore, if the temperature of returning circulating water 23*b* reaches a lower temperature of, for example, 54° F. (or about 12.2° C.), then the programming of thermostat 57, like thermostat 56, will activate resistant water heater 68 when that temperature is reached. This also has the effect of providing additional heat to the circulating water 23*g* entering the chillers. Resistant water heaters 69 and 70 will be activated in similar fashion when their respective temperature sensing devices 58*t* and 59*t* detect a temperature of, for example, 52° F. (or about 11.1° C.) and 50° F. (or about 10.0° C.), thereby activating chillers 38 and 39.

As with load bank 44 illustrated in FIG. 3, the combined effect of incrementally heating circulating water 23*f* based on the temperature programming of thermostats 56,57,58,59, will place a proportionately greater heat load on any one or all of chillers 36,37,38,39 such that their activation will become necessary for maintaining an appropriate supply of chilled water 23*a* to air handlers 42. It will be appreciated that the demand for chilled circulating water 23*a* in air conditioning system 14 is typically and ultimately dictated by the thermostatic demand for cool air in the various compartments of the vessel. The activation of any or all of chillers 36,37,38,39 for maintaining the temperature of the chilled circulating water 23*a* entering air handlers 42 will place a corresponding electrical power demand on generator 12 which will have the effect of creating an increased load on the diesel engine to avoid no-load or low-load operation.

The advantage of using resistant water heaters 67,68,69,70 is that they present another source for creating an electrical power demand on diesel engine generator 12 above that created by the actuation of chillers 36,37,38,39. For this reason, and in accordance with yet another embodiment of the invention, fluid heating means in the form of one or more electrical resistant fluid heating devices, such as the in-line electrical resistant water heaters 67,68,69,70 illustrated in FIG. 4, may be added to the air conditioning system 14 illustrated in FIG. 3. The in-line water heaters (not shown in FIG. 3), which are powered by diesel engine generator 12, may be situated anywhere in conduit 28*d* of circulation loop 28, preferably between the circulating pump 24 and chillers 36,37,38,39, for adding heat to the circulating water 23*f* prior to its entry to chillers 36,37,38,39. The operation of these additional in-line heaters may be undertaken independently of load bank controller 44. They may also be electrically connected with thermostats 56,57,58,59 in the manner illustrated in FIG. 4 for their operation, either independently of valves 48,49,50,51, or in conjunction with them.

The system, apparatus and method according to the invention and various embodiments described above, provides an inexpensive and economical means by which the circulating heat transfer fluid in a closed loop air conditioning system can be utilized for creating a load bank on a marine diesel engine generator. In doing so, the systems, apparatus and methods of the present invention dispense with the need for adding separate and space consuming apparatus associated with conventional load bank systems, and avoids the prohibitive costs associated with their installation and implementation onboard a marine vessel.

Since other modifications and changes may be varied to fit the particular apparatus, operating requirements and environments of the invention, which will be apparent to those skilled in the art, the invention is not considered to be limited to the various aspects and embodiments chosen for purposes of disclosure, and covers all changes and modifications which do not constitute departures from the true spirit and scope thereof.

What is claimed is:

1. A system for maintaining an electrical load on a diesel engine generator for use on a marine vessel comprising:

a) a closed-loop fluid air conditioning system for exchanging heat with the air in said vessel, comprising (i) first heat transfer means that receives therein and discharges therefrom a first heat transfer fluid for ultimately exchanging heat with a second heat transfer fluid, said second heat transfer fluid being supplied to and returned from said vessel within a closed circulation loop for exchanging heat with the air in said vessel; and b) a load bank comprising (i) controller means for diverting at least a portion of the second heat transfer fluid being supplied to said vessel, into heat exchange relationship with a third heat transfer fluid; and (ii) second heat transfer means for exchanging heat between said diverted second heat transfer fluid and said third heat transfer fluid;

whereby the diverted, heat-exchanged second heat transfer fluid is returned to said first heat transfer means for activation thereof thereby creating an electrical power demand on the diesel engine generator.

2. The system according to claim 1 wherein the third heat transfer fluid is the first heat transfer fluid discharged from said first heat transfer means.

3. The system according to claim 2 wherein the first heat transfer fluid comprises seawater.

4. The system according to claim 2 optionally comprising, in addition to said second heat transfer means, a plurality of electrically operated resistant water heaters arranged in parallel relationship relative to each other.

5. The system according to claim 1 wherein the third heat transfer fluid comprises seawater.

6. The system according to claim 1 wherein said secondary heat transfer fluid comprises water, a mixture of ethylene glycol and water, or a mixture of propylene glycol and water, the glycol component being present in its respective mixture in an amount of from about 5 percent to about 25 percent, based on the total volume of the mixture.

7. The system according to claim 1 wherein the first heat transfer means comprises at least one chiller, reverse-cycle chiller or heat pump.

8. The system according to claim 1 wherein the first heat transfer means comprises a plurality of chillers, reverse-cycle chillers, or heat pumps, or combinations thereof, arranged in parallel relationship relative to each other.

9. The system according to claim 1 wherein said portion of second heat transfer fluid being supplied to the vessel is diverted in response to a predetermined temperature value of the returning second heat transfer fluid.

10. The system according to claim 1 wherein said controller means comprises at least one valve for diverting said portion of said second heat transfer fluid being supplied to the vessel.

11. The system according to claim 10 wherein said valve is operably coupled with a thermostat, said valve being operated in response to a thermostat setting reflective of a predetermined temperature of the returning second heat transfer fluid.

12. The system according to claim 11 wherein said controller means comprises a plurality of valves and corresponding thermostats.

13. The system according to claim 12 wherein each valve is operably coupled with its corresponding thermostat, each of said thermostats being in temperature sensing relationship with the returning second heat transfer fluid, each of said valves being operated in response to a signal generated by its corresponding thermostat reflective of a predetermined temperature of the returning second heat transfer fluid detected upstream of its corresponding valve.

14. The system according to claim 1 wherein the second heat transfer means comprises a heat exchanger.

15. The system according to claim 14 wherein the heat exchanger is a plate type heat exchanger, a shell and tube type heat exchanger, or a tube and tube type heat exchanger.

16. The system according to claim 1 optionally comprising, in addition to said second heat transfer means, one or more electrical resistant fluid heating devices in communication with the returning second heat transfer fluid for heating the same.

17. The system according to claim 16 wherein said fluid heating device is a resistant water heater.

18. A system for maintaining an electrical load on a diesel engine generator for use on a marine vessel comprising:

a) a closed-loop chilled-fluid air conditioning system for cooling the air in said vessel comprising:

(i) at least one source of heat transfer that receives therein and discharges therefrom a first heat transfer fluid for ultimately exchanging heat with a second heat transfer fluid, said second heat transfer fluid being supplied to and returned from said vessel within a closed circulation loop for cooling the air in said vessel; and b) a load bank comprising (i) a controller for diverting at least a portion of the second heat transfer fluid being supplied to said vessel, into heat exchange relationship with a third heat transfer fluid; and (ii) a heat exchanger for transferring heat from the third heat transfer fluid to the diverted portion of second heat transfer fluid;

whereby the heated, diverted second heat transfer fluid is returned to said source of heat transfer for activation thereof to create an electrical power demand on the diesel engine generator for maintaining a load thereon.

19. The system according to claim 18 wherein the third heat transfer fluid is the first heat transfer fluid discharged from said source of heat transfer.

20. The system according to claim 19 wherein the first heat transfer fluid comprises seawater.

21. The system according to claim 20 wherein the second heat transfer fluid comprises water, a mixture of ethylene glycol and water, or a mixture of propylene glycol and water, the glycol component being present in its respective mixture in an amount of from about 5 percent to about 25 percent, based on the total volume of the mixture.

22. The system according to claim 21 wherein the air conditioning system comprises a plurality of chillers or reverse-cycle chillers, or combinations thereof, arranged in parallel relationship relative to each other.

23. The system according to claim 22 wherein the controller comprises a plurality of valves and corresponding thermostats, said thermostats being in temperature sensing relationship with the returning second heat transfer fluid, and each of said valves being operated in response to a signal generated by its corresponding thermostat reflective of a predetermined temperature of the returning second heat transfer fluid detected upstream of its corresponding valve.

24. The system according to claim 18 wherein (a) the first heat transfer fluid comprises seawater;

(b) the second heat transfer fluid comprises water, a mixture of ethylene glycol and water, or a mixture of propylene glycol and water, the glycol component being present in its respective mixture in an amount of from about 5 percent to about 25 percent, based on the total volume of the mixture; and (c) the third heat transfer fluid comprises seawater provided to said heat exchanger independently of said source of heat transfer.

25. The system according to claim 18 wherein said source of heat transfer comprises a chiller or reverse-cycle chiller.

26. The system according to claim 18 wherein the controller comprises at least one valve for diverting said portion of said second heat transfer fluid being supplied to the vessel.

27. The system according to claim 26 wherein said valve is operably coupled with a thermostat, said valve being operated in response to a thermostat setting reflective of a predetermined temperature of the returning second heat transfer fluid.

28. The system according to claim 27 wherein the controller comprises a plurality of valves and corresponding thermostats.

29. The system according to claim 18 wherein the heat exchanger is a plate type heat exchanger, a shell and tube type heat exchanger, or a tube and tube type heat exchanger.

30. The system according to claim 18 optionally comprising, in addition to said heat exchanger, one or more electrical resistant fluid heating devices, powered by said diesel engine generator, in communication with the returning second heat transfer fluid for transferring heat to the same.

31. The system according to claim 30 wherein the fluid heating device comprises an electrically operated resistant water heater.

32. A system for maintaining an electrical load on a diesel engine generator for use on a marine vessel comprising:

a) a closed-loop chilled-fluid air conditioning system for cooling the air in said vessel comprising (i) at least one source of heat transfer that receives therein and discharges therefrom a first heat transfer fluid for ultimately exchanging heat with a second heat transfer fluid, said second heat transfer fluid being supplied to and returned from said vessel within a closed circulation loop for cooling the air in said vessel; and b) a load bank comprising (i) fluid heating means comprising one or more electrical resistant fluid heating devices operably coupled with a controller means for heating the second heat transfer fluid returning from the vessel to said source of heat transfer in response to a predetermined temperature of the returning heat transfer fluid detected upstream of the fluid heating means;

whereby the heated second heat transfer fluid is returned to said source of heat transfer for activation thereof to create an electrical power demand on the diesel engine generator for maintaining a load thereon.

33. The system according to claim 32 wherein the first heat transfer fluid comprises seawater and the second heat transfer fluid comprises water, a mixture of ethylene glycol and water, or a mixture of propylene glycol and water, the glycol component being present in its respective mixture in an amount of from about 5 percent to about 25 percent, based on the total volume of the mixture.

34. The system according to claim 33 wherein the source of heat transfer comprises a plurality of chillers or reverse-cycle chillers, or combinations thereof, arranged in parallel relationship relative to each other.

35. The system according to claim 34 wherein said fluid heating means comprises a plurality of electrically operated resistant water heaters arranged in parallel relationship relative to each other and powered by said diesel engine generator.

36. The system according to claim 34 wherein said load bank comprises a plurality of electrically operated resistant water heaters, arranged in parallel relationship relative to each other, each water heater being powered by said diesel engine generator and operably coupled with and controlled by a corresponding thermostat in response to a thermostat setting reflective of a predetermined temperature of the returning second heat transfer fluid detected upstream of its corresponding water heater.

37. The system according to claim 32 wherein the source of heat transfer comprise a chiller or reverse-cycle chiller.

38. The system according to claim 32 wherein said fluid heating means comprises at least one electrically operated resistant water heater powered by said diesel engine generator.

39. The system according to claim 32 wherein said controller means comprises at least one thermostat, said thermostat being in temperature sensing relationship with the returning second heat transfer fluid.

40. A system for maintaining an electrical load on a diesel engine generator for use on a marine vessel comprising:

a) a closed-loop fluid air conditioning system for heating the air in said vessel comprising:

(i) at least one source of heat transfer that receives therein and discharges therefrom a first heat transfer fluid for ultimately exchanging heat with a second heat transfer fluid, said second heat transfer fluid being supplied to and returned from said vessel within a closed circulation loop for heating the air in said vessel; and b) a load bank comprising (i) a controller for diverting at least a portion of the second heat transfer fluid being supplied to said vessel, into heat exchange relationship with a third heat transfer fluid; and (ii) a heat exchanger for transferring heat from the third heat transfer fluid to the diverted portion of second heat transfer fluid;

whereby the heated, diverted second heat transfer fluid is returned to said source of heat transfer for activation thereof to create an electrical power demand on the diesel engine generator for maintaining a load thereon.

41. The system according to claim 40 wherein the third heat transfer fluid is the first heat transfer fluid discharged from said source of heat transfer.

42. The system according to claim 41 wherein the first heat transfer fluid comprises seawater.

43. The system according to claim 42 wherein the second heat transfer fluid comprises water, a mixture of ethylene glycol and water, or a mixture of propylene glycol and water, the glycol component being present in its respective mixture in an amount of from about 5 percent to about 25 percent, based on the total volume of the mixture.

44. The system according to claim 43 wherein the air conditioning system comprises a plurality of reverse-cycle chillers or heat pumps, or combinations thereof, arranged in parallel relationship relative to each other.

45. The system according to claim 44 wherein the controller comprises a plurality of valves and corresponding thermostats, said thermostats being in temperature sensing relationship with the returning second heat transfer fluid, and each of said valves being operated in response to a signal generated by its corresponding thermostat reflective of a predetermined temperature of the returning second heat transfer fluid detected upstream of its corresponding valve.

46. The system according to claim 40 wherein (a) the first heat transfer fluid comprises seawater;

(b) the second heat transfer fluid comprises water, a mixture of ethylene glycol and water, or a mixture of propylene glycol and water, the glycol component being present in its respective mixture in an amount of from about 5 percent to about 25 percent, based on the total volume of the mixture; and (c) the third heat transfer fluid comprises seawater provided to said heat exchanger independently of said source of heat transfer.

47. The system according to claim 40 wherein said source of heat transfer comprises a reverse-cycle chiller or heat pump.

48. The system according to claim 40 wherein the controller comprises at least one valve for diverting said portion of said second heat transfer fluid being supplied to the vessel.

49. The system according to claim 48 wherein said valve is operably coupled with a thermostat, said valve being operated in response to a thermostat setting reflective of a predetermined temperature of the returning second heat transfer fluid.

50. The system according to claim 49 wherein the controller comprises a plurality of valves and corresponding thermostats.

51. The system according to claim 40 wherein the heat exchanger is a plate type heat exchanger, a shell and tube type heat exchanger, or a tube and tube type heat exchanger.

52. The system according to claim 40 optionally comprising, in addition to said source of heat transfer, one or more electrical resistant fluid heating devices, powered by said diesel engine generator, in communication with the second heat transfer fluid being supplied to the vessel for heating the same.

53. The system according to claim 52 wherein the fluid heating device comprises an electrically operated resistant water heater.

54. A load bank for a marine diesel engine generator electrically coupled with a source of heat transfer in a closed-loop fluid air conditioning system that receives and discharges a primary heat transfer fluid for ultimately exchanging heat with a secondary heat transfer fluid, the secondary heat transfer fluid being supplied to and returned from the compartments of a marine vessel within a closed circulation loop for exchanging heat with the air in the vessel compartments, comprising:

(a) controller means for diverting at least a portion of the secondary heat transfer fluid supply into heat exchange relationship with a tertiary heat transfer fluid; and (b) a heat exchanger for exchanging heat between the diverted secondary heat transfer fluid and the tertiary heat transfer fluid;

whereby the diverted, heat-exchanged, secondary heat transfer fluid is returned to said source of heat transfer for activation thereof to create an electrical power demand on the diesel engine generator for maintaining a load thereon.

55. The load bank according to claim 54 wherein the primary heat transfer fluid and tertiary heat transfer fluid is seawater.

56. The load bank according to claim 55 wherein the tertiary heat transfer fluid is the seawater discharged from said source of heat transfer.

57. The system according to claim 55 wherein said secondary heat transfer fluid comprises water, a mixture of ethylene glycol and water, or a mixture of propylene glycol and water, the glycol component being present in its respective mixture in an amount of from about 5 percent to about 25 percent, based on the total volume of the mixture.

58. The load bank according to claim 54 wherein the controller means comprises at least one valve.

59. The load bank according to claim 58 wherein said valve is operably coupled with a thermostat that is in temperature sensing relationship with the returning secondary heat transfer fluid from said vessel, said valve being operated in response to a signal generated by said thermostat reflective of a predetermined temperature of the returning secondary heat transfer fluid detected upstream of said valve.

60. The load bank according to claim 59 wherein the controller means comprises a plurality of valves and corresponding thermostats, said valves being arranged in parallel relationship relative to each other.

61. The load bank according to claim 54 wherein the heat exchanger is a plate type heat exchanger, a shell and tube type heat exchanger or a tube and tube type heat exchanger.

62. A method for maintaining a load on a diesel engine generator onboard a marine vessel utilizing the circulating heat transfer fluid contained within the closed circulation loop of a fluid air conditioning system to exchange heat with the air in said vessel, comprising:

(a) transporting a primary heat transfer fluid through a first heat transfer means of the closed circulation loop fluid air conditioning system for ultimately exchanging heat with the circulating heat transfer fluid;

(b) supplying and returning the circulating heat transfer fluid in the closed circulation loop to and from the vessel, respectively, for heat exchange with the air therein;

(c) diverting at least a portion of the circulating heat transfer fluid being supplied to the vessel, into heat exchange relationship with a tertiary heat transfer fluid; and (d) returning the diverted, heat-exchanged circulating heat transfer fluid to said first heat transfer means whereby said first heat transfer means is activated to create an electrical power demand on the diesel engine generator for maintaining a load thereon.

63. The method according to claim 62 wherein the first heat transfer means comprises a chiller, a reverse-cycle chiller or a heat pump.

64. The method according to claim 62 wherein the first heat transfer means comprises a plurality of chillers, a reverse-cycle chillers or heat pumps, or combinations thereof, arranged in parallel relationship relative to each other.

65. The method according to claim 62 wherein the heat exchange of the diverted portion of circulating heat transfer fluid and primary heat transfer fluid is undertaken by a second heat transfer means comprising a heat exchanger.

66. The method according to claim 65 wherein the portion of circulating heat transfer fluid being supplied to the vessel is diverted in response to a predetermined temperature value of the returning primary heat transfer fluid.

67. The method according to claim 66 wherein the portion of circulating heat transfer fluid is diverted by a controller means comprising at least one valve.

68. The method according to claim 67 wherein said valve is operably coupled with a thermostat that is in temperature sensing relationship with the returning circulating heat transfer fluid, said valve being operated in response to a thermostat setting reflective of the temperature of the returning circulating heat transfer fluid detected upstream of said valve.

69. The method according to claim 66 wherein the controller means comprises a plurality of valves and corresponding thermostats.

70. The method according to claim 65 wherein the heat exchanger is a plate type heat exchanger, a shell and tube type heat exchanger, or a tube and tube type heat exchanger.

71. The method according to claim 62 wherein the primary heat transfer fluid comprises seawater.

72. The method according to claim 71 wherein the tertiary heat transfer fluid comprises seawater.

73. The method according to claim 71 wherein the tertiary heat transfer fluid comprises the seawater discharged from said first heat transfer means.

74. The method according to claim 62 wherein the circulating heat transfer fluid comprises water, a mixture of ethylene glycol and water, or a mixture of propylene glycol and water, the glycol component being present in its respective mixture in an amount of from about 5 percent to about 25 percent, based on the total volume of the mixture.

75. A method for maintaining a load on a diesel engine generator onboard a marine vessel utilizing the circulating heat transfer fluid contained within the closed circulation loop of a chilled fluid air conditioning system that includes at least one chiller or reverse-cycle chiller, comprising:

(a) supplying and returning the heat transfer fluid in the closed circulation loop to and from the vessel, respectively, for cooling the air therein;

(b) heating the heat transfer fluid returning from the vessel to said chiller or reverse-cycle chiller; and (c) returning the heated heat transfer fluid to the chiller or reverse-cycle chiller for activating the same to create an electrical power demand on the diesel engine generator for maintaining a load thereon.

76. The method according to claim 75 wherein the heat transfer fluid is heated with at least one electrical resistant fluid heating device.

77. The method according to claim 76 wherein said fluid heating device comprises an electrically operated resistant water heater.

78. The method according to claim 76 wherein said resistant fluid heating device is operated in response to a predetermined temperature value of the returning heat transfer fluid.

79. The method according to claim 78 wherein the operation of said fluid heating device is controlled by a thermostat, said thermostat being in temperature sensing relationship with the returning heat transfer fluid upstream of said fluid heating device.

80. The method according to claim 75 wherein the returning heat transfer fluid is heated by a plurality of resistant water heaters, each water heater being operably controlled by a corresponding thermostat in response to a thermostat setting reflective of a predetermined temperature of the returning heat transfer fluid detected upstream of said resistant water heaters.

81. The method according to claim 75 wherein the heat transfer fluid comprises water, a mixture of ethylene glycol and water, or a mixture of propylene glycol and water, the glycol component being present in its respective mixture in an amount of from about 5 percent to about 25 percent, based on the total volume of the mixture.

82. A system for maintaining an electrical load on a diesel engine generator for use on a marine vessel comprising:

(a) a closed-loop fluid air conditioning system for heating the air in said vessel comprising:

(i) a fluid heating means, powered by said diesel engine generator, comprising at least one electrical resistant fluid heating device for heating a first heat transfer fluid being supplied to and returned from said vessel within a closed circulation loop for heating the air in said vessel; and (b) a load bank comprising (i) controller means for diverting at least a portion of the first heat transfer fluid being supplied to said vessel, into heat exchange relationship with a second heat transfer fluid; and (ii) a heat exchanger for exchanging heat between the second heat transfer fluid and the diverted portion of the first heat transfer fluid;

whereby the heat-exchanged, diverted first heat transfer fluid is returned to said fluid heating means for activation thereof to create an electrical power demand on the diesel engine generator for maintaining a load thereon.

83. The system according to claim 82 wherein said first heat transfer fluid comprises water, a mixture of ethylene glycol and water, or a mixture of propylene glycol and water, said glycols being present in their respective mixtures in an amount of from about 5 percent to about 25 percent, based on the total volume of the mixture.

84. The system according to claim 83 wherein said fluid heating means comprises a plurality of electrically operated resistant water heaters arranged in parallel relationship relative to each other.

85. The system according to claim 83 wherein the second heat transfer fluid comprises seawater.

86. The system according to claim 82 wherein said fluid heating means comprises an electrically operated resistant water heater.

87. The system according to claim 82 wherein said controller means comprises at least one valve for diverting said portion of said heat transfer fluid being supplied to the vessel.

88. The system according to claim 87 wherein said valve is operably coupled with a thermostat, said valve being operated in response to a thermostat setting reflective of a predetermined temperature of the returning first heat transfer fluid.

89. The system according to claim 82 wherein said controller means comprises a plurality of valves and corresponding thermostats.

90. The system according to claim 89 wherein each valve is operably coupled with its corresponding thermostat, each of said thermostats being in temperature sensing relationship with the returning first heat transfer fluid upstream of its corresponding valve, each of said valves being operated in response to a signal generated by its corresponding thermostat reflective of a predetermined temperature of the returning first heat transfer fluid.

91. The system according to claim 82 wherein the heat exchanger is a plate type heat exchanger, a shell and tube type heat exchanger or a tube and tube type heat exchanger.

* * * * *